US006543091B2

(12) United States Patent
Patel

(10) Patent No.: US 6,543,091 B2
(45) Date of Patent: Apr. 8, 2003

(54) APPARATUS AND METHODS FOR STRIPPING COTTON

(75) Inventor: Mansukhbhai Baldevbhai Patel, Ahmedabad (IN)

(73) Assignee: Society for Research and Initiatives (SRISTI) (IN)

( * ) Notice: Subject to any disclaimer, the term of this patent is extended or adjusted under 35 U.S.C. 154(b) by 0 days.

(21) Appl. No.: 10/040,959

(22) Filed: Jan. 7, 2002

(65) Prior Publication Data

US 2002/0092133 A1 Jul. 18, 2002

(30) Foreign Application Priority Data

Jan. 8, 2001 (IN) ..... 18/MUM/2001

(51) Int. Cl.[7] ..... D02J 7/00
(52) U.S. Cl. ..... 19/200; 19/39; 19/64.5
(58) Field of Search ..... 19/39, 40, 41, 19/44, 48 R, 49, 50, 51, 53, 64.5, 65 A, 65 R, 200, 202, 203, 204, 205; 56/28, 33, 34, 40, 48

(56) References Cited

U.S. PATENT DOCUMENTS

| | | | | | |
|---|---|---|---|---|---|
| 1,750,439 | A | * | 3/1930 | Streun | 19/37 |
| 1,760,312 | A | * | 5/1930 | Mitchell | 56/34 |
| 2,081,412 | A | * | 5/1937 | Streun | 19/37 |
| 2,668,989 | A | * | 2/1954 | Vandergriff | 19/36 |
| 2,739,353 | A | * | 3/1956 | Mitchell et al. | 19/1 |
| 2,825,096 | A | * | 3/1958 | Moss | 19/202 |
| 3,035,312 | A | * | 5/1962 | Cox | 19/202 |
| 3,327,459 | A | * | 6/1967 | Logan | 56/28 |
| 3,343,226 | A | * | 9/1967 | Davis et al. | 19/27 |
| 3,512,237 | A | * | 5/1970 | Elder et al. | 56/28 |
| 4,214,348 | A | * | 7/1980 | Schwartz et al. | 19/203 |
| 4,229,286 | A | * | 10/1980 | Bridges | 19/200 |
| 4,313,296 | A | | 2/1982 | Mitchell, Jr. | 56/34 |
| 5,490,372 | A | | 2/1996 | Schlueter | 56/33 |
| 5,842,332 | A | | 12/1998 | Schreiner | 56/28 |
| 6,094,898 | A | | 8/2000 | Goering et al. | 56/34 |

* cited by examiner

*Primary Examiner*—Gary Welch
(74) *Attorney, Agent, or Firm*—Testa, Hurwitz & Thibeault, LLP

(57) ABSTRACT

Disclosed are methods and apparatus for stripping petals from cotton balls. In one embodiment, the cotton stripper includes an impacter for at least partially opening the cotton balls, a first cleaning mechanism to discard petals removed by the impacter, and a cotton separator for removing the remaining petals from the cotton balls. In one embodiment, the cotton separator includes a first large roller, which receives and traps the at least partially opened cotton balls from the first cleaning mechanism. The at least partially opened cotton balls rotate with the first large roller toward a first net. Petals on the cotton balls are stripped off by the first net. Petals removed by the first net fall toward the bottom of the cotton separator. A first small roller then removes the first stripped cotton balls from the first large roller. Processed cotton balls are then stored in an output area.

20 Claims, 5 Drawing Sheets

APPARATUS AND METHODS FOR STRIPPING COTTON

RELATED APPLICATIONS

The present application claims priority to Indian Patent Application No. 18/MUM/2001 filed on Jan. 8, 2001.

FIELD OF THE INVENTION

The present invention relates generally to the field of cotton processing and, more specifically, to stripping petals from cotton balls.

BACKGROUND OF THE INVENTION

The separation of petals from cotton balls can be a very labor-intensive effort. In order to minimize the effort required to separate petals from cotton balls, cotton separators have been used. Typically, cotton separators use crushers to crush the petals. However, crushing the petals can result in small pieces of petals sticking to the cotton ball. The small pieces of petals that stick to the cotton ball are very difficult to separate from the cotton ball. In addition, it is possible for the small pieces of petal to reach the last stage of a fiber produced from the cotton ball, and the small pieces of petal can ultimately damage the whole fabric.

One of the components used in existing cotton separators are large rollers with a wire mesh around the circumference of the roller. The wire mesh on the rollers is frequently damaged during operation as small stones and hard petals can cause considerable damage to the wire mesh. The damage to the wire mesh results in frequent replacement of the mesh. In some instances the wire mesh has to be replaced every 15 days. The replacement of the wire mesh can be costly and may prevent the further processing of cotton for 3 to 4 days.

Existing cotton separators generally require at least three workers to operate the machine. One worker pours cotton balls encased in petals in the hopper of the cotton separator. Another worker clears away striped petals, and another worker collects stripped cotton balls. In addition, workers collecting stripped petals can be exposed to rotating parts, which can potentially injure the workers.

Existing cotton separators do not remove all of the petals from the cotton balls during processing, necessitating reprocessing of the cotton balls to remove any petals that remain. This reprocessing of cotton balls results in higher production costs.

SUMMARY OF THE INVENTION

The present invention relates to an apparatus for stripping petals from cotton balls. In one embodiment, the apparatus includes a hopper to store raw cotton balls encased in petals, an impacter to partially open the raw cotton balls and remove some of the petals, a first cleaning mechanism to discard some of the petals that are removed by the impacter, and a cotton separator. The cotton separator includes a first large roller encased in a first mesh material rotating at a first speed to capture the at least partially opened cotton balls, a first net located at a circumferential position adjacent to the first large roller to strip off petals, and a first small roller rotating at a second speed to take the first stripped cotton balls from the first large roller. The second speed of the first small roller is faster than the first speed of the first large roller.

In another embodiment of the present invention, the cotton separator also includes a second large roller encased in the first mesh material rotating at the first speed to capture the first stripped cotton balls, a second net located at a circumferential position adjacent to the second large roller to strip off petals, and a second small roller encased in the second mesh material rotating at the second speed to take the second stripped cotton balls from the second large roller.

In yet another embodiment of the present invention, the cotton separator also includes a third large roller located below the first large roller and the second large roller The third large roller is encased in the first mesh material rotating at the first speed to capture the first or second stripped cotton balls. The cotton separator further includes a third net located at a circumferential position adjacent to the third large roller to strip off petals, and a third small roller encased in the second mesh material rotating at the second speed to take the second or third stripped cotton balls from the second large roller.

In yet another embodiment of the present invention, the cotton separator also includes a worm wheel to remove petals from the cotton separator.

In yet another embodiment of the present invention, the impacter includes a shaft, a plurality of spikes connected to the shaft, the plurality of spikes is connected to the shaft in a worm wheel configuration, and the shaft is supported by a housing.

Finally, in yet another embodiment of the present invention, the apparatus further includes a suction mechanism to both supply raw cotton balls to the impacter and remove impurities from the raw cotton balls.

BRIEF DESCRIPTION OF THE DRAWINGS

The foregoing and other objects, features, and advantages of the present invention, as well as the invention itself, will be more fully understood from the following description of various embodiments, when read together with the accompanying drawings, in which.

DESCRIPTION OF PREFERRED EMBODIMENT

Figure 1:
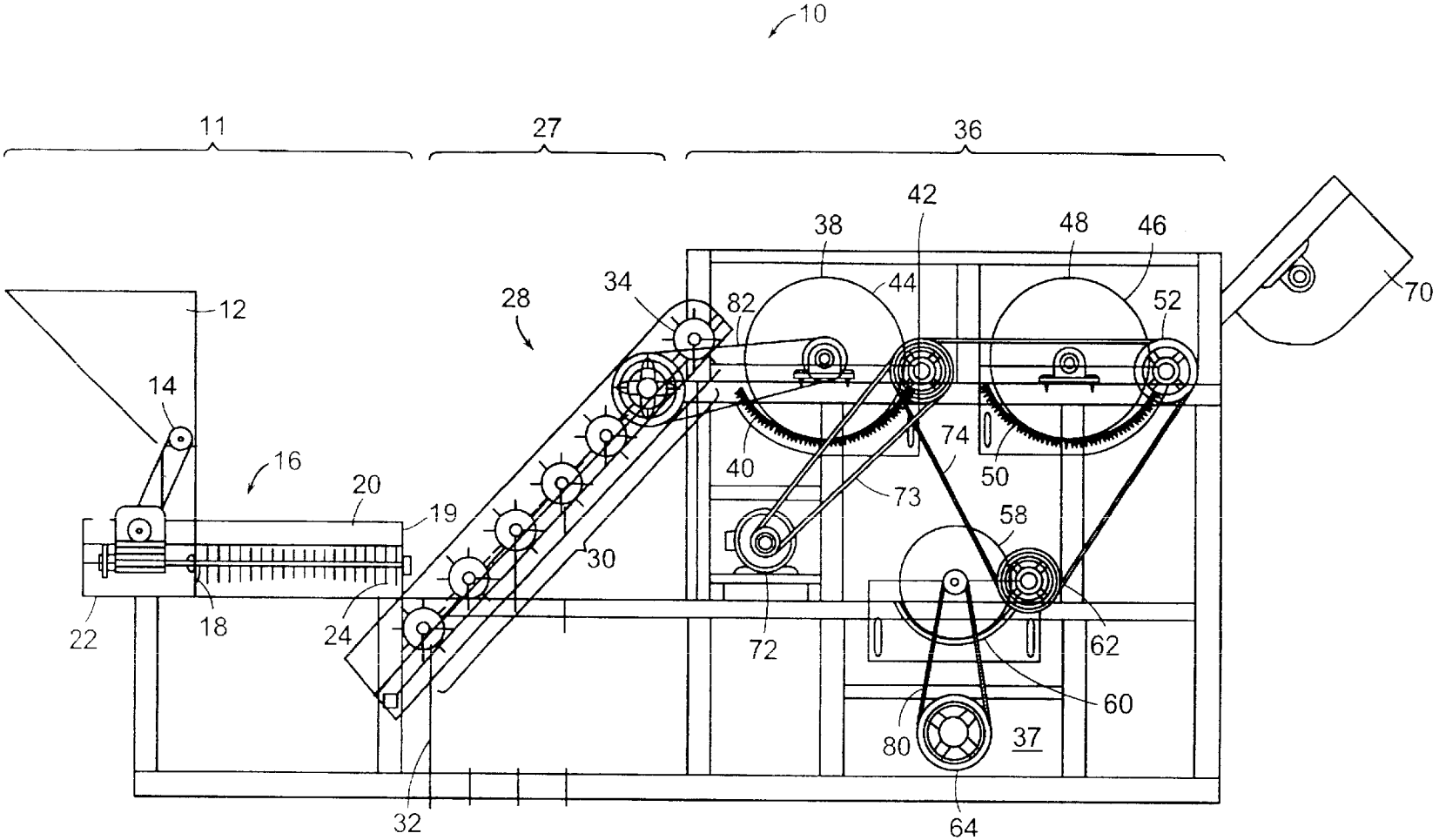
FIG. 1 is a front view of an embodiment of the current invention illustrating a cotton stripper.

FIG. 1 illustrates a preferred embodiment of a cotton stripper 10 for stripping petals from cotton balls. The cotton stripper 10 includes a feeder 11, where the feeder 11 includes a hopper 12, a feed roller 14, and an impacter 16. A user pours cotton balls encased in petals into the hopper 12. The feed roller 14 passes the cotton balls encased in petals to the impacter 16.

The impacter 16 includes a shaft 18, and a plurality of spikes 20 connected to the shaft 18, which is supported by a housing 19. The housing 19 can be made from any durable metal, plastic, or composite material known to those skilled in the art. In another embodiment, more than one shaft with a plurality of spikes can be used.

The plurality of spikes 20 are arranged in a worm wheel configuration having the plurality of spikes oriented at different angles to transport cotton balls with petals from the first end 22 of the impacter 16 to the second end 24 of the impacter 16. In one embodiment, the shaft 18 can rotate from about 100 rpm to 1,250 rpm. In another embodiment, the shaft 18 can rotate from about 500 rpm to 1,000 rpm. In a most preferred embodiment, the shaft 18 can rotate at about 750 rpm.

The cotton balls encased in petals strike the rotating plurality of spikes 20, which causes the petals to at least partially split open from the impact with the plurality of spikes 20. In addition, the partially opened cotton balls are then thrown by the plurality of spikes 20 into the housing 19, which further opens the partially opened cotton balls. The combination of impacts from the plurality of spikes 20 and the housing 19 causes the cotton balls encased in petals to open almost completely.

There is very little clearance between the plurality of spikes 20 and the housing 19. In one embodiment, the clearance between the plurality of spikes 20 and the housing 19 can range from about 0.6 in. to 1.6 in. Grooves (not shown) are formed inside the housing 19 to act as a guide for forward motion of the at least partially opened cotton balls. The combination of the plurality of spikes 20 configured in a worm wheel configuration, the small clearance between the plurality of spikes 20 and the housing 19, along with the grooves in the housing 19 cause the at least partially opened cotton balls to move toward the second end of the impacter 24 in an efficient manner.

The at least partially opened cotton balls and petals are then moved to, a transporter 27, which includes a first cleaning mechanism 28 The first cleaning mechanism 28 includes a plurality of spiked rollers 30. The plurality of spiked rollers 30 are configured to pass the at least partially opened cotton balls o first spiked roller 32 in the plurality spiked rollers 30 to the last spiked roller 34 in the plurality of spiked rollers. In one embodiment, the plurality of spiked rollers 30 are oriented in an upward direction.

The first cleaning mechanism 28 allows petals that have been removed by the impacter 16 to be separated from the at least partially opened cotton balls as the at last partially opened cotton balls are transported along the plurality of spiked rollers 30.

The at least partially opened cotton balls are transported from the first cleaning mechanism 28 to the cotton separator 36. In one embodiment, the cotton separator includes a first large roller 38, a first net 40 circumferentially adjacent to the first large roller 38, and a first small roller 42. The first net 40 is positioned just below the first large roller 38. In one embodiment, the first large roller 38 is about 10 inches to 50 inches in diameter. In another embodiment, the first large roller 38 is about 20 inches to 40 inches in diameter. In a preferred embodiment, the first large roller 38 is about 26 inches in diameter.

Figure 2:
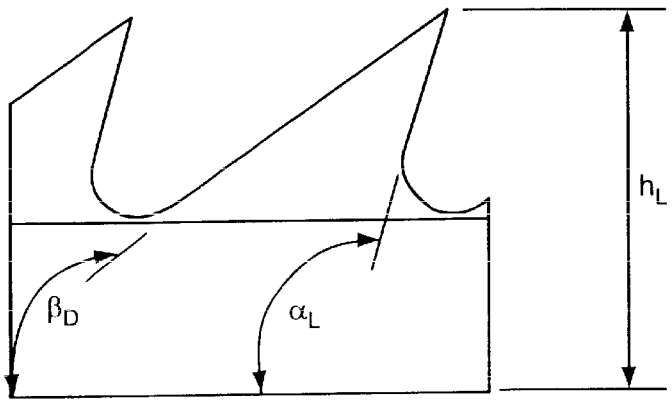
FIG. 2 is a schematic diagram of an embodiment of the current invention illustrating licker-in wire.

The first large roller 38 is encased in a first material 44, which in one embodiment can be a licker-in wire. Licker-in wire is used as a clothing in carding machines for the purpose of opening fiber tufts. Licker-in wire has sharp points, which are used to penetrate the at least partially opened cotton balls. Persons skilled in the art can choose the parameters of the licker-in wire to meet the needs of a particular application. FIG. 2 illustrates an embodiment of one type of licker-in wire where the spikes can have a height range $h_L$ from 0.20 to 0.22 inches, a front angle range $\beta_L$ from 55 to 90 degress and a back angle $\beta_L$ range from 25 to 50 degrees. In one embodiment, the licker-in wire can be model number D2811506042 from Indian Card Clothing based in Pune, India.

In one embodiment, the first large roller 38 rotates from about 50 to 1,000. In another embodiment, the first large roller 38 rotates from about 100 to 500. In a preferred embodiment, the-first large roller 38 rotates at about 250 rpm.

Figure 3:
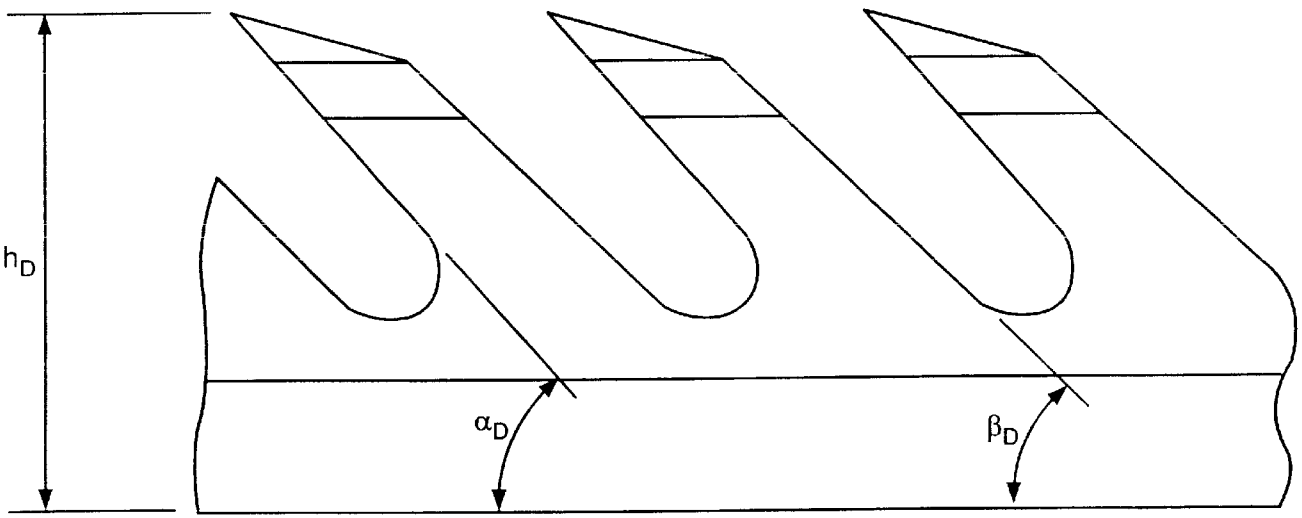
FIG. 3 is a schematic diagram of an embodiment of the current invention illustrating doffer wire.

The first small roller 42 is adjacent to the first large roller 38. In one embodiment, the first small roller 42 and is about 1/16 to 3/4 of the size of the first large roller 38. In another embodiment, the first small roller 42 and is about 1/8 to 1/2 of the size of the first large roller 38. In a preferred embodiment, the first small roller 42 is about a 1/4 of the size of the first large roller 38. The first small roller 42 is encased in a second material 46, which in one embodiment can be a doffer wire. Doffer wire is a clothing used in carding machines for collecting condensed masses of fibers circulating on a cylinder. In the present application, as described in more detail below, the doffer wire is used as the second material 46 to collect first stripped cotton balls from the first large roller 38. FIG. 3 illustrates an embodiment of one type of doffer wire where the doffer wire can have a height range $h_D$ from 0.16 to 0.20 inches, a front angle range $\alpha_D$ from 50 to 60 degrees and a back angle $\beta_D$ from 20 to 42 degrees. In one embodiment, the doffer wire can be model number L0006557040 from Indian Card Clothing. Persons skilled in the art can choose the parameters of the doffer wire to meet the needs of a particular application.

In one embodiment, the first small roller 42 rotates from about 200 to 5,000 rpm. In another embodiment, the first small roller 42 rotates from about 500 to 2,500 rpm. In a preferred embodiment, the first small roller 42 rotates at about 1,000 rpm.

The first large roller 38 encased in the first material 44, receives and traps the at least partially opened cotton balls from the first cleaning mechanism 28. The at least partially opened cotton balls now rotate with the first large roller 38 toward the first net 40. There is a very tight clearance between the first large roller 38 and first net 40, so that petals still remaining on the cotton balls are stripped off by the first net. In a preferred embodiment, the clearance between the first large roller 38 and the first net 40 is adjustable and can be varied from about 0.1 inches to 0.6 inches. Petals that are removed by the first net 40 fall toward the bottom 37 of the cotton separator 36. The first small roller 42 then removes the first stripped cotton balls from the first large roller 38.

In one embodiment, the cotton separator 36 further includes a second large roller 48, a second net 50 adjacent to the second large roller 48, and a second small roller 52. The second net 50 is positioned just below the second large roller 48. The second large roller 48 is encased in first material 44. In one embodiment, the second large roller 48 is from 10 inches to 50 inches in diameter. In another embodiment, the second large roller 48 is about 20 inches to 40 inches in diameter. In a preferred embodiment, the second large roller 48 is about 26 inches in diameter.

In one embodiment, the second large roller 48 rotates at about 50 to 1,000. In another embodiment, the second large roller 48 rotates at about 100 to 500. In a preferred embodiment, the second large roller 48 rotates at about 250 rpm.

The second small roller 52 is positioned adjacent to the second large roller 48. In one embodiment, the second small roller 52 and is about 1/16 to 3/4 of the size of the second large roller 48. In another embodiment, the second small roller 52 is about 1/8 to 1/2 of the size of the second large roller 48. In a preferred embodiment, the second small roller 52 is about 1/4 of the size of the second large roller 48. The second small roller 52 is also encased in the second material 46.

In one embodiment, the second small roller 52 rotates from about 250 to 5,000 rpm. In another embodiment, the second small roller 52 rotates from about 500 to 2,500 rpm. In a preferred embodiment, the second small roller 52 rotates about 1,000 rpm.

The second large roller 48 encased in the first material 44, receives and traps the first stripped cotton balls from the first small roller 42. The at least partially opened cotton balls now rotate with the second large roller 48 toward the second net 50. There is a very tight clearance between the second large roller 48 and second net 50, so that petals still remaining on the cotton balls are stripped off by the second net 50. In a preferred embodiment, the clearance between the second large roller 48 and the second net 50 is adjustable and can be varied from around 0.1 inches to 0.6 inches. Petals that are removed by the second net 50 fall toward the bottom 37 of the cotton separator 36. The second small roller 52 then removes the second stripped cotton balls from the second large roller 48.

In another embodiment, the cotton stripper further includes a third large roller 58, a third net 60 and a third small roller 62. The third large roller 58, third net 60 adjacent to the third large roller 58, and third small roller 62 are located below first large roller 38 and second large roller 48 to process any cotton balls that were stripped off by the first net 40 or second net 50. The third net 60 is positioned just below the third large roller 58. The third large roller 58 is encased in the first material 44. In one embodiment, the third large roller 58 is about 10 inches to 50 inches in diameter. In another embodiment, the third large roller 58 is about 20 inches to 40 inches in diameter. In a preferred embodiment, the third large roller 58 is 18 inches in diameter.

In one embodiment, the third large roller 58 rotates from about 50 to 1,000. In another embodiment, the third large roller 58 rotates from about 100 to 500. In a preferred embodiment, the third large roller 58 rotates at about 200 rpm.

The third small roller 62 is adjacent to the third large roller 58. In one embodiment, the third small roller 62 is about 1/16 to 3/4 of the size of the third large roller 58. In another embodiment, the third small roller 62 is about 1/8 to 1/2 of the size of the third large roller 58. In a preferred embodiment, the third small roller 62 is about 1/4 of the size of the third large roller 58. The third small roller 42 is also encased in the second material 46.

In one embodiment, the third small roller 62 rotates from about 200 to 500 rpm. In another embodiment, the third small roller 62 rotates from about 500 to 2,500 rpm. In a preferred embodiment, the third small roller 62 rotates at 1,000 rpm.

The third large roller 58 encased in the first material 44, receives and traps cotton balls that were stripped off from the first large roller 38 by the first net 40 or cotton balls stripped off the second large roller 48 by the second net 50. The first or second stripped cotton balls now rotate with the third large roller 58 toward the third net 60. There is a very tight clearance between the third large roller 58 and third net 60, so that petals still remaining on the cotton balls are stripped off by the third net 60. In a preferred embodiment, the clearance between the third large roller 58 and the third net 60 is adjustable and can be varied from around 0.1 inches to 0.6 inches. Petals that are removed by the third net 60 fall toward the bottom of the cotton separator 37.

The materials used for the first through third large rollers and the first through third small rollers can be manufactured from a large array of metals or alloys known to those skilled in the art. In one embodiment, the large rollers can be made from cast iron and the small rollers can be made from mild steel.

In one embodiment, the cotton separator 36 further comprises an output area 70 for storing second and third stripped cotton balls.

In another embodiment, the cotton separator 36 further comprises a worm wheel 64, located proximate the bottom of the cotton separator 37 to transport stripped petals out of the cotton separator 36.

The elements of the cotton stripper 10 can be driven in an almost unlimited variety of ways. In one embodiment the first small roller 42, the second small roller 52, and the third small roller 62 can be driven by a first motor 72, first motor belt 73 and small rotor belt 74. The first motor 72 can be selected from a large range of horsepower depending on the particular application. In one embodiment, the first motor 72 can have a horsepower of about 2 horsepower.

Figure 4:
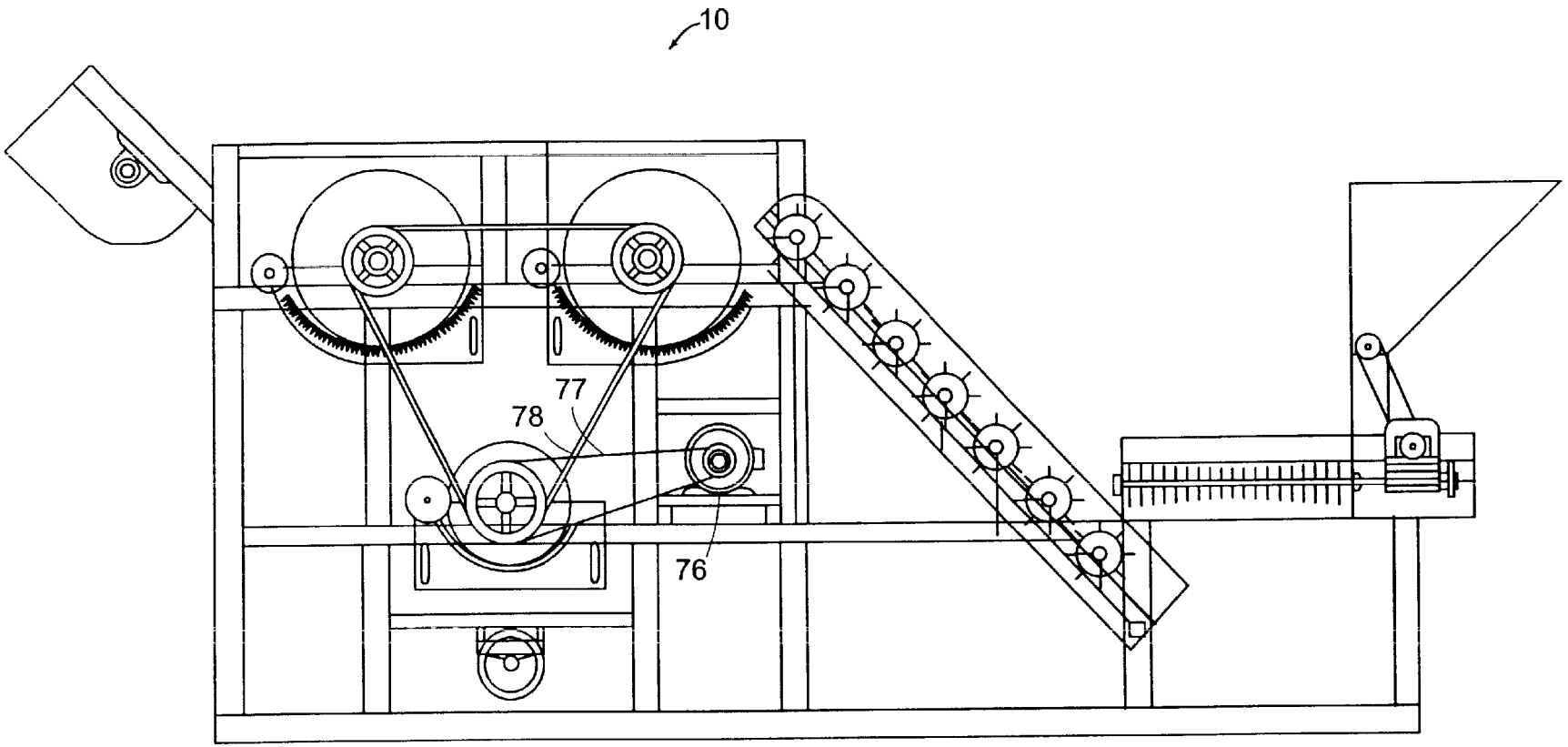
FIG. 4 is a back view of an embodiment of the current invention illustrating the cotton stripper.

In one embodiment, the first large roller 38, the second large roller 48 and the third large roller 58 can be driven by a second motor 76, a second motor belt 77 and a large roller belt 78 as shown in FIG. 4. In addition, as shown in FIG. 1, the worm wheel 64 can be driven by a worm wheel belt 80 running off the third large roller 58. Further, the plurality of spiked rollers 30 of the first cleaning mechanism 28 can be driven by spiked roller belt 82 running off first large roller 38. The second motor 76 can be selected from a large range of horsepower depending on the particular application. In one embodiment, the second motor 76 can have a horsepower of about 1 horsepower.

Figure 5:
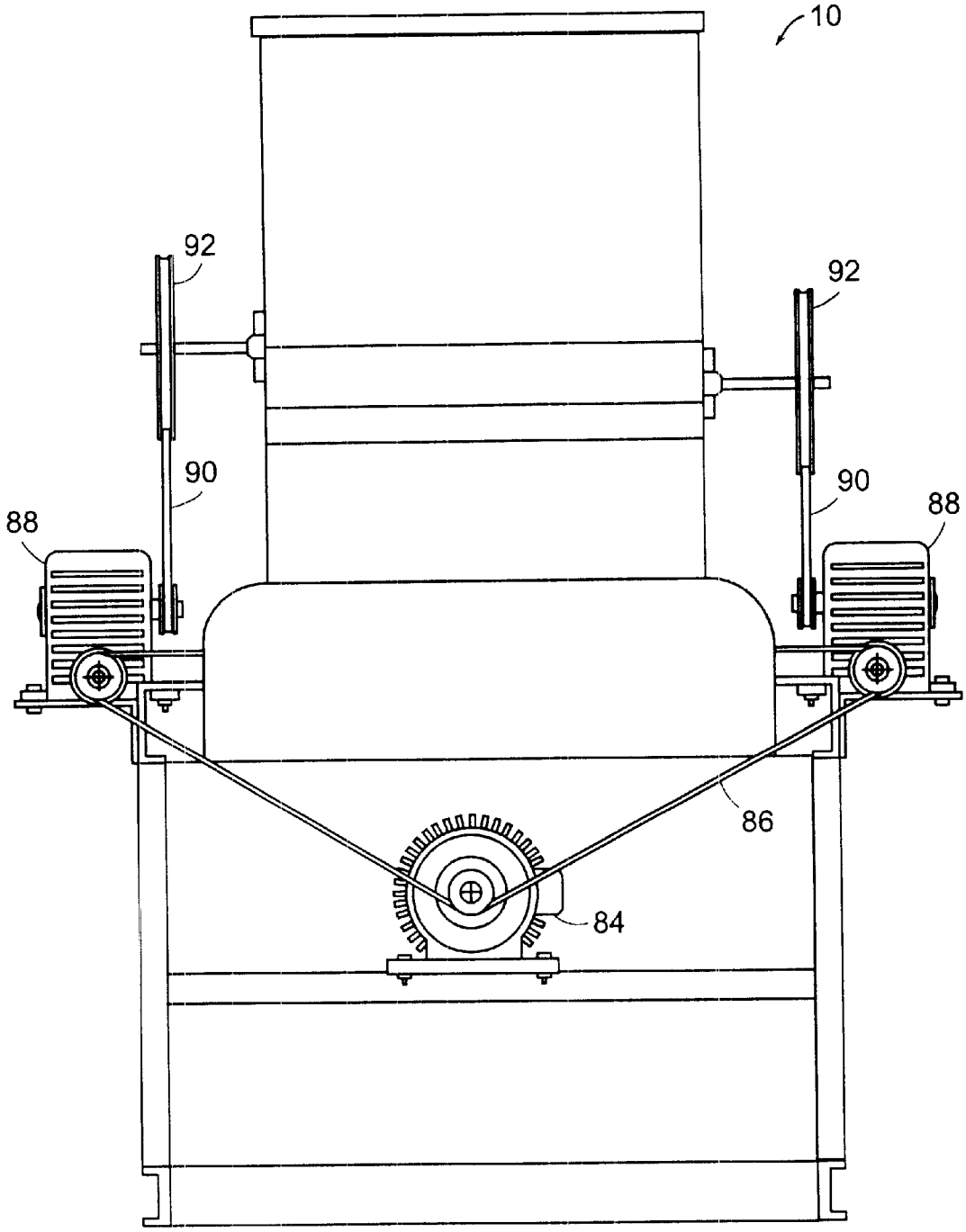
FIG. 5 is a side view of an embodiment of the current invention illustrating a cotton stripper.

In one embodiment, as shown in FIG. 5, the feed roller 14 in the hopper 12 can be driven by a third motor 84 via a third motor belt 86, a plurality of gear boxes 88, a plurality of hopper belts 90, and a plurality of hopper pulleys 92. The shaft 18 with the plurality of spikes 20 can be driven by one of the gear boxes 92. The third motor 84 can be selected from a large range of horsepower depending on the particular application. In one embodiment, the third motor 84 can have a horsepower of about 3 horsepower. In one embodiment, the cotton stripper 10 can process 900 pounds of cottons balls encased in petals per hour.

Figure 6:
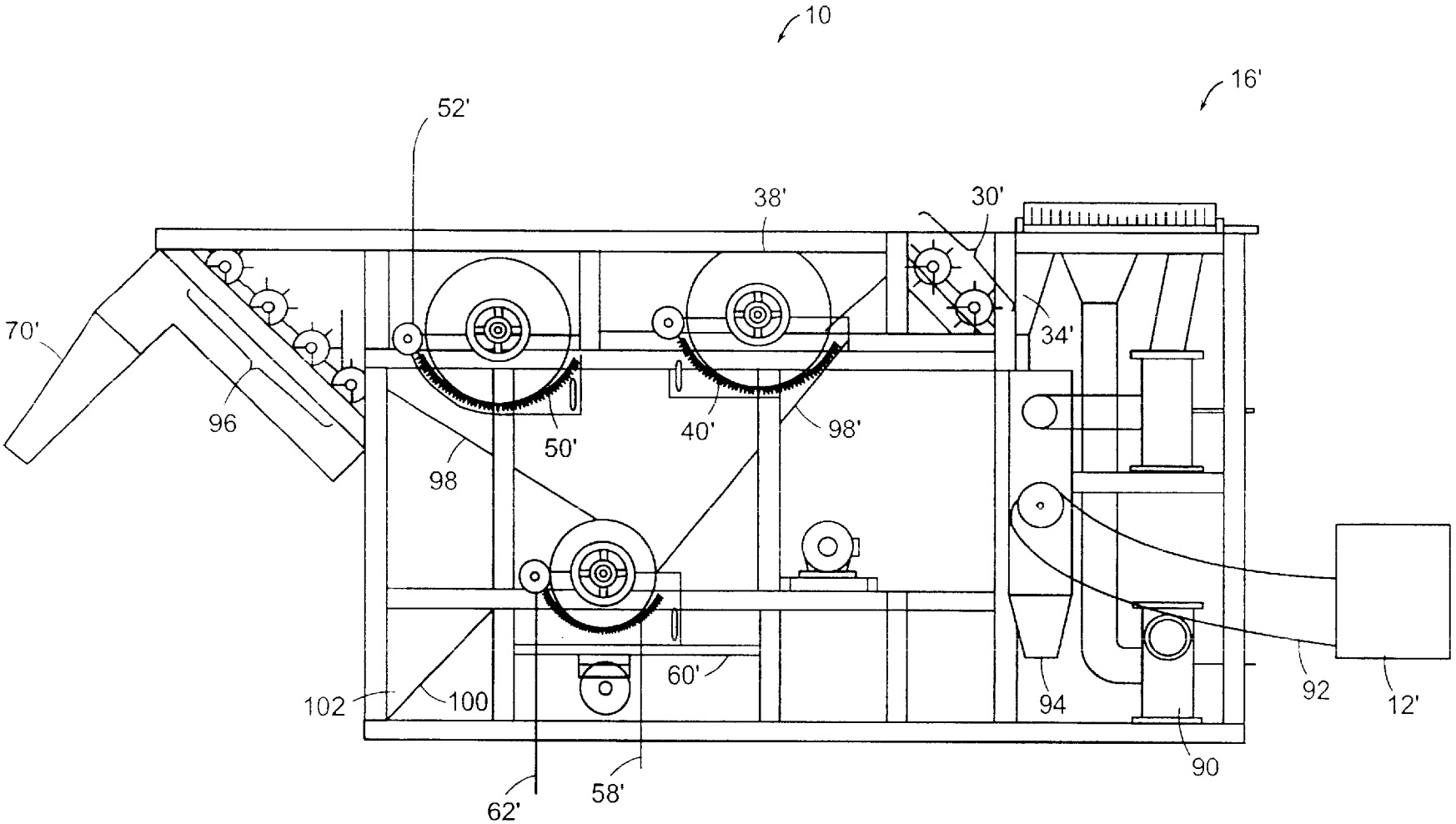
FIG. 6 is a front view of another embodiment of the current invention illustrating a cotton stripper.

In yet another embodiment, shown in FIG. 6, a suction mechanism 90 can be added to the cotton stripper 10 to suck raw cotton balls from the hopper 12' via a flexible tube 92 to the impacter 16'. The suction mechanism 90 is sized to allow raw cotton balls to be sucked up to the impacter 16', but the suction provided is not strong enough to suck impurities like stones, which fall out through rejection port 94. By removing impurities through the use of the suction mechanism 90, the life of the licker-in wire will be improved. Additionally, a suction port 94 can be positioned near the impacter 16' to suck away small impurities such as dust from the impacter 16'.

In the embodiment shown in FIG. 6, the number of spiked rollers 30' can be reduced to two spiked rollers due to the cleaning of the cotton balls provided by the suction mechanism 90, and because the section mechanism 90 has also lifted the cotton ball closer to the height of the first large roller 38'.

In another embodiment, a second plurality of spiked rollers 96 can be added after the second small roller 52' to remove any impurities left on the second stripped cotton balls while the second stripped cotton balls being transported to the output area 70'. Inclined plates 98 can be used to guide any cotton balls that were stripped off by the first net 40' or the second net 50' to be further processed by the third large roller 58', the third small roller 62' and the third net 60'. Cotton ball processed by the third large roller 58', the third small roller 62' and the third net 60' are then guided by inclined plate 100 to a second output area 102.

Variations, modifications, and other implementations of what is described herein will occur to those of ordinary skill in the art without departing from the spirit and the scope of the invention as claimed. Accordingly, the invention is to be defined not by the preceding illustrative descriptions, but instead by the following claims.

What is claimed is:

1. A cotton stripper, the cotton stripper comprising:

a hopper to store raw cotton balls encased in petals;

an impacter in process communication with the hopper;

a first cleaning mechanism in process communication with the impacter;

a cotton separator in process communication with the first cleaning mechanism, the cotton separator comprising;

a first large roller encased in a first mesh material rotating at a first speed;

a first net located at a circumferential position adjacent to the first large roller; and a first small roller encased in a second mesh material rotating at a second speed and adjacent the first large roller, wherein the impacter at least partially opens the raw cotton balls and removes some petals, the first cleaning mechanism discards petals that were removed by the impacter, the first large roller captures the at least partially opened raw cotton balls, the first net strips off petals, and the first small roller takes the first stripped cotton balls from the first large roller.

2. The invention according to claim 1 wherein the second speed is faster than the first speed.

3. The invention according to claim 1 wherein the cotton separator further comprises:

a second large roller encased in the first mesh material rotating at the first speed;

a second net located at a circumferential position adjacent to the second large roller; and a second small roller encased in the second mesh material rotating at the second speed and adjacent to the second large roller, wherein the second large roller captures the first stripped cotton balls, the second net strips off petals and the second small roller takes the second stripped cotton balls from the second large roller.

4. The invention according to claim 3 wherein the cotton separator further comprises:

a third large roller encased in the first mesh material rotating at the first speed;

a third net located at a circumferential position adjacent to the third large roller; and a third small roller encased in the second mesh material rotating at the second speed and adjacent the third large roller, wherein the third large roller, the third net, and third small roller are below the first large roller, the first net, the first small roller, the second large roller, the second net and the second small roller, and further wherein, the third large roller captures the first or second stripped cotton balls, the third net strips off petals and the third small roller takes the second or third stripped cotton balls from the third large roller.

5. The invention according to claim 1 wherein the first mesh material comprises licker-in wire.

6. The invention according to claim 1 wherein the second mesh material comprises doffer wire.

7. The invention according to claim 1 wherein the cotton separator further comprises a worm wheel to remove petals from the cotton separator.

8. The invention according to claim 1 further comprising an output area in process communication with the cotton separator for storing cotton balls after they pass through the cotton separator.

9. The invention according to claim 1 wherein the hopper comprises a feed roller to transport the raw cotton balls encased in petals to the impacter.

10. The invention according to claim 1 wherein the impacter comprises:

a shaft;

a plurality of spikes connected to the shaft, wherein the spikes are arranged to form a worm wheel configuration; and a housing to support the shaft.

11. The invention according to claim 10 wherein the housing further comprises grooves.

12. The invention according to claim 1 wherein the first cleaning mechanism comprises a plurality of spiked rollers.

13. The invention according to claim 12 wherein the plurality of spiked rollers are configured to pass the at least partially opened raw cotton balls from a first spiked roller in the plurality of spiked rollers to a last spiked roller in the plurality of spiked rollers.

14. The invention according to claim 1 further comprising a suction mechanism in process communication with the hopper and the impacter.

15. A method for stripping petals from cotton balls, the method comprising:

loading raw cotton balls encased in petals into a hopper;

impacting the raw cotton balls encased in petals to at least partially open the cotton balls;

discarding petals that were removed by the impacter;

capturing the at least partially opened cotton balls on a first large roller;

rotating the first large roller rotating at a first speed past a first net to strip petals off the at least partially opened cotton balls; and capturing the first stripped cotton balls on a first small roller rotating at a second speed.

16. The method according to claim 15 wherein the second speed is faster than the first speed.

17. The method according to claim 15 further comprising the step of transporting the first stripped cotton ball to an output area.

18. The method according to claim 15 further comprising the step of removing stripped petals from an area under the first net.

19. The method according to claim 15 further comprising the step of sucking raw cotton balls from the hopper to the impacter.

20. A cotton stripper for stripping petals from cotton balls, the cotton stripper comprising:

a hopper;

an impacter in process communication with the hopper;

a first cleaning mechanism in process communication with the impacter;

a cotton separator in process communication with the first cleaning mechanism, the cotton separator comprising;

a first large roller encased in a licker-in wire rotating at a first speed;

a first net located at a circumferential position adjacent to the first large roller;

a first small roller encased in a doffer wire rotating at a second speed and adjacent the first large roller, wherein the second speed is faster than the first speed;

a second large roller encased in a licker-in wire rotating at the first speed;

a second net located at a circumferential position adjacent to the second large roller;

a second small roller encased in a doffer wire rotating at the second speed and adjacent to the second large, a third large roller encased in a licker-in wire rotating at the first speed, and located below the first large roller and second large roller;

a third net located at a circumferential position adjacent to the third large roller;

a third small roller encased in doffer wire rotating at the second speed and adjacent the third large roller; and an output area in process communication with the cotton separator, wherein the impacter at least partially opens the raw cotton balls and removes some petals, the first cleaning mechanism discards petals that were removed by the impacter, the first large roller captures the at least partially opened raw cotton balls, the first net strips off petals, the first small roller takes the first stripped cotton balls from the first large roller, the second large roller captures the first stripped cotton balls, the second net strips off petals, the second small roller takes the second stripped cotton balls from the second large roller, the third large roller captures the first or second stripped cotton balls, the third net strips off petals, the third small roller takes the second or third stripped cotton balls from the third large roller and the output area stores second or third stripped cotton balls.

* * * * *

UNITED STATES PATENT AND TRADEMARK OFFICE

CERTIFICATE OF CORRECTION

PATENT NO. : 6,543,091 B2
DATED : April 8, 2003
INVENTOR(S) : Patel

It is certified that error appears in the above-identified patent and that said Letters Patent is hereby corrected as shown below:

Column 9,
Line 15, after the word “large” delete “,” and insert -- roller; --.

Signed and Sealed this

Eighteenth Day of November, 2003

JAMES E. ROGAN
*Director of the United States Patent and Trademark Office*